United States Patent [19]

Robinson

[11] Patent Number: 5,076,187

[45] Date of Patent: Dec. 31, 1991

[54] SAILS AWAY

[76] Inventor: Dwight Robinson, 235 Talache Rd., Sagle, Id. 83860

[21] Appl. No.: 440,780

[22] Filed: Jan. 16, 1990

[51] Int. Cl.[5] ..... B63H 9/10

[52] U.S. Cl. ..... 114/105; 114/104

[58] Field of Search ..... 114/104, 105, 39.1

[56] References Cited

U.S. PATENT DOCUMENTS

| | | | |
|---|---|---|---|
| 639,916 | 12/1899 | Achterberg | 114/105 |
| 843,822 | 2/1907 | Jennings | 114/105 |
| 4,280,431 | 7/1981 | Sofen | 114/105 |
| 4,347,799 | 9/1982 | Moriarty | 114/105 |
| 4,844,136 | 7/1989 | Vavlitis | 114/104 |
| 4,895,092 | 1/1990 | Schmeising | 114/104 |
| 4,951,589 | 8/1990 | Pfeffer | 114/102 |

*Primary Examiner*—Sherman Basinger
*Assistant Examiner*—Thomas J. Brahan

[57] ABSTRACT

A device for gathering in and folding the mainsail on the boom of a sailboat. Four battens are inserted into the slots of the batten holders, which are secured to the boom with fasteners, forming a cradle projecting out at 45° from vertical on both sides of the boom, that holds the mainsail in place when raising or lowering.

1 Claim, 2 Drawing Sheets

SAILS AWAY

BACKGROUND OF THE INVENTION (1) Since I have been sailing for the past 30 years, it occurred to me there must be an easy way to control the mainsail of a sailboat. The mainsail of a sailboat has a tendency to thrash and flutter in heavy winds and makes the sailboat difficult to handle, as well as, having the sail blow over on to the deck or rails while raising or lowering. This invention is an easy to use device to control the mainsail so it will fold on to the boom and not allow the mainsail to drop to the deck, causing damage to the sail. This device is used when (1) raising the mainsail and (2) when lowering the mainsail. The device consists of 4 battens, two on each side of the boom, that slip into slots located in the center of the batten holder. The batten holders are secured to the boom by two screws in each holder.

PRIOR ART

There are several types of mainsail furling devices on the market and operation of these devices are discussed as follows:

(1) "Lazy Jacks" a mainsail furling device, most popular with the sailboat market place, uses an inverted "λ" which consists of lines fastened to the upper part of the sail and is fastened to the boom fore and aft. These lines are on both sides of the boom acting as a guide for the sail when raised or lowered to prevent the mainsail from falling on the deck. There are three drawbacks for this device:

(a) Chafing and wearing the mainsail when sail is raised and sailboat is sailing.

(b) Blocks, guides and lines add considerable expense.

(c) Necessary to remove Lazy Jacks lines in order to install sail cover when mainsail is secured to boom.

(2) Mainsail furling device for a sailboat, U.S. Pat. No. 4,895,092, Inventor—Henry F. Schmeising, consisting of mechanical brackets with pivotable arms that fold against the boom and a deployed position perpendicular to the boom. This device is advertised in "Sail" magazine for $150.00 and has the following disadvantages:

(a) Clutters the boom with large brackets that adds weight and gets in the way of reefing lines used in heavy winds.

(b) Cost is too high.

(c) Requires the modification or replacement of sail cover in order to cover the brackets even though the arms are folded against the boom.

(3) A device for furling a sail comprising a support structure, a retaining structure fixed to the support structure and elongated removable guide structure, U.S. Pat. No. 4,844,136, Jul. 4, 1989 by Jason Vavlitis. The following are reasons why this device would be unacceptable and is a different concept than my invention:

(a) The support structure curvature would mate with very few sailboat booms. Since most sailboat booms are pearshaped, this fixed curve on the support structure would not fit most of todays sailboat booms. My holders fit all sailboat booms due to the narrow (¾") thickness mating to boom curvature.

(b) The guide structure attached to the above mentioned support structure is shown as 4° from vertical. It is unlikely the mainsail would fit or fold into this small angle, forming approximately 4" to 5" across at the boom. This area would require lowering the mainsail and using two persons folding or forcing the mainsail by hand between the opening, and also, the luffing sail would fall outside the guides, when lowered. My batten arms are 45° from vertical, which is the absolute minimum required to gather in and have the mainsail fold itself.

(c) It would be a difficult task to collect twelve (12) sail furling rods and insert them into the twelve (12) guide structures while the boom is moving from the force of the wind and the rocking of the sailboat. Also, a sail furling rod with a ½" diameter could be a potential hazard to the mainsail and could cause punctures when the sail did not fit into the guides and spilled over the rods. My battens slip easily in an adequately sized slot in the holders, since they are flat (1½" across) and are not detrimental to the mainsail.

(d) The vertical rods are held in the retaining tube by solder, weld, or glue in order to prevent them from falling through, whereas my battens are inserted into the holders slot and bottom against the boom. No additional solder, weld or glue is required for this operation.

(e) An aluminum rod is not considered marine hardware and should not be on a sailboat. Fiberglass battens are used in the sails for stiffeners and used in the sailboat industry. By the time 12 guide structures were placed in the holders as illustrated in the patent figures, the mainsail could be lowered and secured quicker by hand.

SUMMARY

It is the intention of this inventor to create an inexpensive simple to use device that is accepted on all sailboat booms and yet is small enough not to conflict with other functions of the boom, heavy weight, reefing lines etc. These mainsail furling device holders are positioned on the boom of a sailboat so that the slot in the holder is at an angle of 45° from vertical. A batten (battens have been standard equipment on sailboat for many years and this makes a significant difference between my invention and all others) is then slipped into the holders forming an arm extending far enough on both sides of the boom, midway fore and aft of the horizontal center of the boom, to hold or cradle the mainsail when raising or lowering. The four (4) holders which are secured to the boom by two (2) stainless steel screws for each holder are small enough to be out of the way for any sail cover or mainsail reefing (shortening sail) lines. The battens are flexible yet virtually indestructable. The furling device functions as follows: First, the sailcover is removed from the mainsail and the four (4) battens inserted into the holders. The mainsail stops or lines (which tie up or hold the mainsail) are removed and the mainsail is cradled in the battens. The mainsail is then raised and the battens are removed. When the mainsail is ready to be lowered, the sailboat is pointed into the wind and the battens inserted into the batten holders. The end of the boom is then clipped to the aft stay (which supports the boom) and the mainsail is lowered into the battens. The mainsail is then secured to the boom with stops and the battens removed. The sailcover is then installed.

List of reference characters:

No. 4 - battens holders

No. 5 - stainless steel screws

No. 6 - fiberglass batten

No. 7 - sailboat boom
No. 8 - mainsail lowered to boom
No. 9 - mainsail raised
No. 10 - depicts sailboat

PREFERRED EMBODIMENTS

Figure 1:
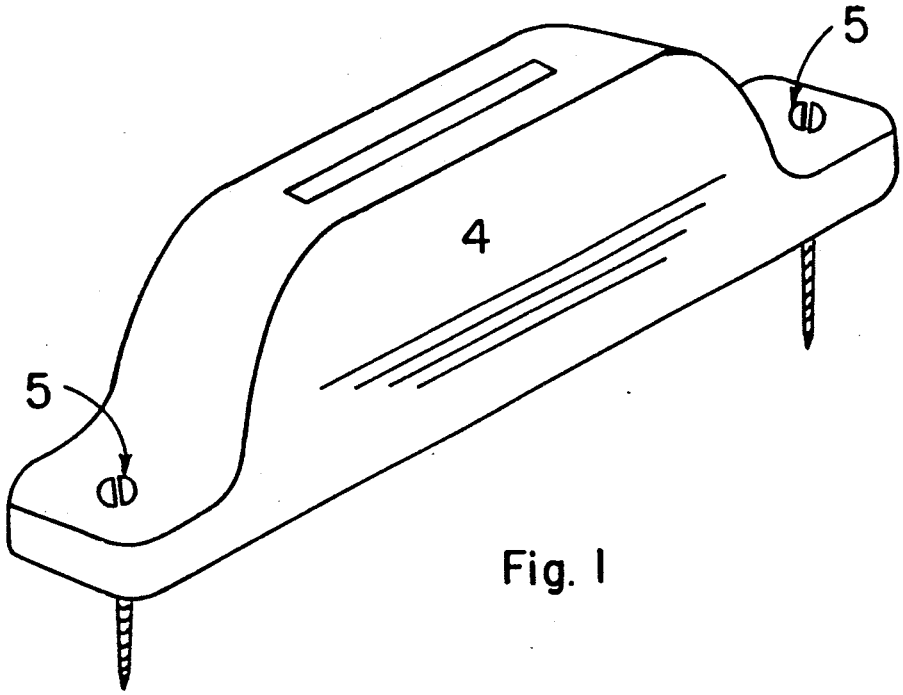
FIG. 1 - Batten holder with (2) screws
FIG. 2 - Battens
FIG. 3 - Batten inserted into batten holders supporting mainsail when lowered
FIG. 4 - Sailboat with mainsail raised and battens ready to be removed.
Figure 2:
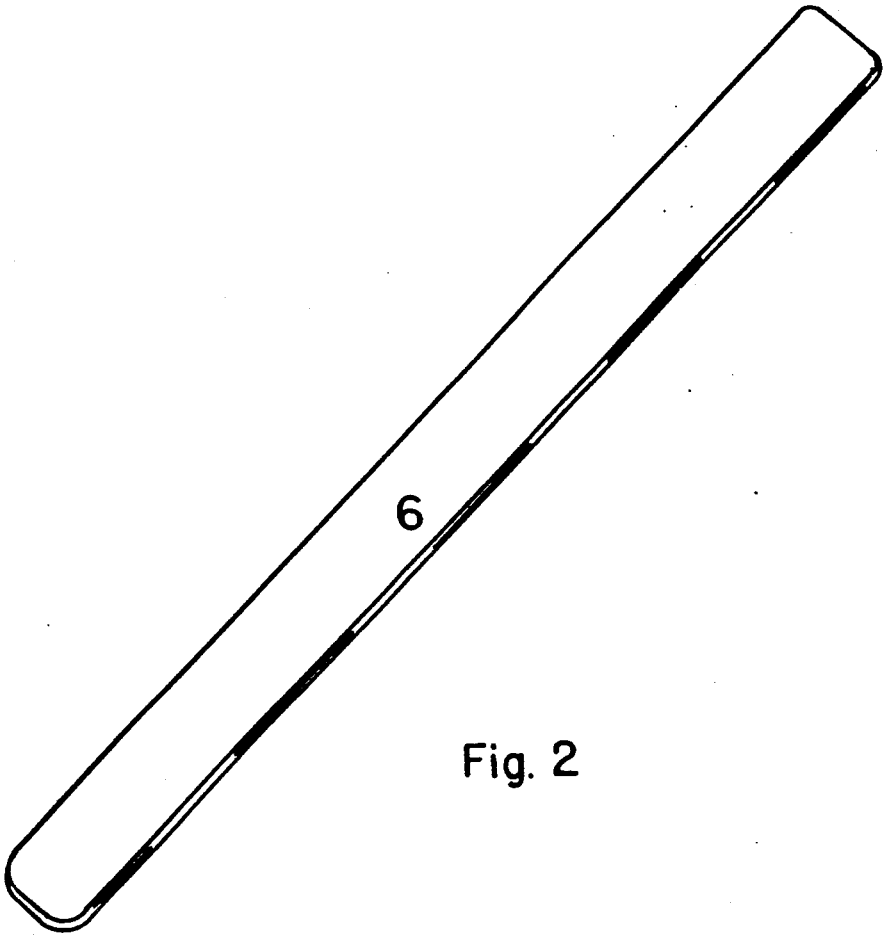

Referring to FIG. 1—A small ultra violet protected plastic holder 3 inches in length, ¾ inches wide, and 1 inch in height, 4 with two holes 5/32 inch diameter to accommodate two (2) screws that secure the holder 4 to the boom 7. The holder 4 has a slot on the center to accept and support the batten 6. Referring to FIG. 2—A 24 inch long by ⅛ inch thick and 1½ inch wide fiberglass batten 6 which slips into slot of holder 4.

OPERATION OF EMBODIMENTS

Figure 3:
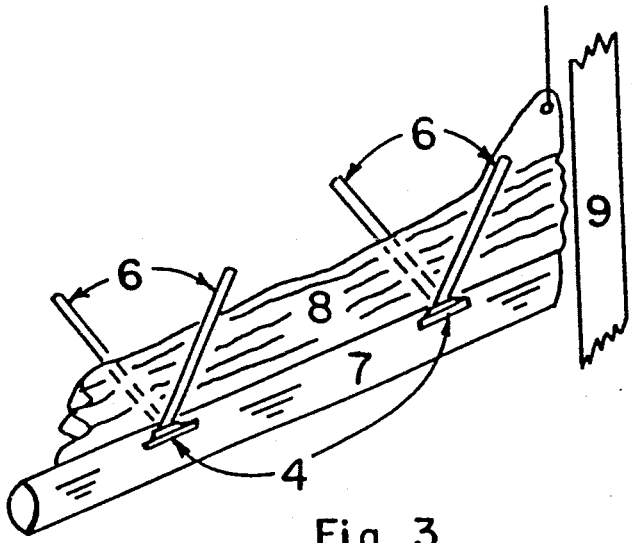

Referring to FIG. 3—shows the mainsail 8 resting on the boom 7 with the battens 6 inserted into the holder 4 supporting and cradling the mainsail 8 so it cannot fall to the deck.

Figure 4:
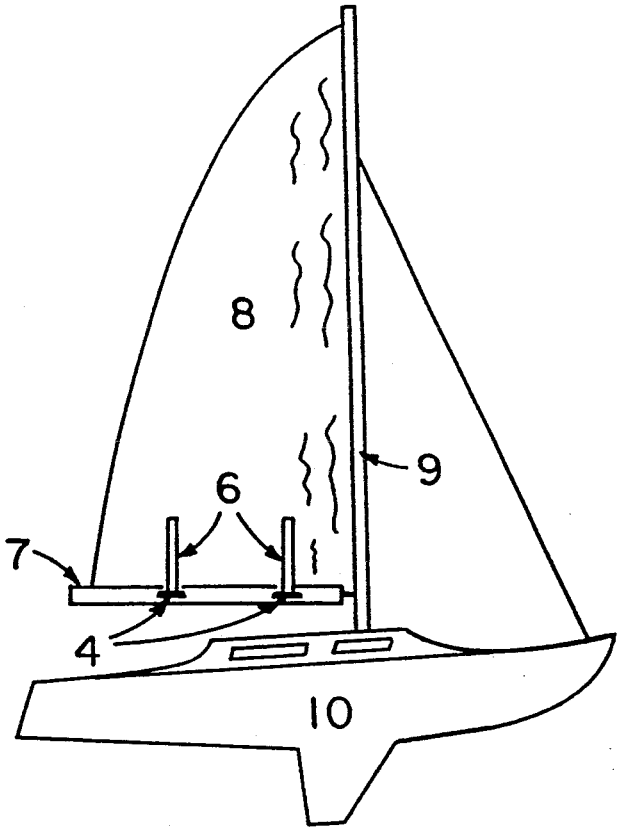

Referring to FIG. 4—the mainsail 8 is in the raised position and the battens 6 are ready to be removed and stored. When the captain is ready to lower the mainsail 8 the operation is done as follows:

The four (4) battens 6 are inserted into the holders 4, the sailboat 10 is pointed to windward and the mainsail 8 lowered, allowing the battens 6 to gather the mainsail 8 and fold it as it is lowered. The mainsail 8 is then secured to the boom with sail stops and the battens 6 removed.

What is claimed is as follows:

1. A system for furling a sail comprising a plurality of spaced brackets located along each side of a sail boom, each of said brackets removably supporting a respective batten, each of said brackets comprising an elongated one piece unitary element having a top surface, a bottom surface, and parallel side surfaces, said element having an elongated slot extending through the top surface and the bottom surface and parallel to the side surfaces, said elongated slot being sized to receive its respective batten, said element having a pair of bores, one at each end of the said elongated slot, extending through said top surface and said bottom surface for receiving mounting screws, and said bottom surface of said element being at an angle greater than 90° with one of said side walls as to have said respective batten extend upwardly when the bracket is mounted on a vertical surface of said boom.

* * * * *